United States Patent [19]

Becker et al.

[11] 4,202,226

[45] May 13, 1980

[54] METHOD AND APPARATUS FOR MANUFACTURING PLASTIC LENSES

[75] Inventors: Ronald K. Becker, Arlington; Donald R. Korb, Boston, both of Mass.

[73] Assignee: SyntexLaboratories, Inc., Palo Alto, Calif.

[21] Appl. No.: 875,394

[22] Filed: Feb. 6, 1978

[51] Int. Cl.[2] ..... B23B 5/40

[52] U.S. Cl. ..... 82/12; 82/11; 82/25

[58] Field of Search ..... 82/12, 11, 25

[56] References Cited

U.S. PATENT DOCUMENTS

| | | | |
|---|---|---|---|
| 1,264,375 | 4/1918 | Derrom | 82/12 |
| 3,100,955 | 8/1963 | Kratt | 82/12 |
| 3,909,982 | 10/1975 | Schlodtfeldt | 82/12 |
| 4,084,458 | 4/1978 | Galley | 82/12 |

*Primary Examiner*—Leonidas Vlachos
*Attorney, Agent, or Firm*—Dike, Bronstein, Roberts, Cushman & Pfund

[57] ABSTRACT

The method of making plastic lenses ready for fitting to the contour of the wearer's eye comprising supporting a blank of plastic at one end for rotation about a predetermined axis, turning the blank down to a predetermined diameter, making an annular face cut at the distal end of the blank of predetermined radial width, making a spherically concave base cut at said distal end of predetermined depth relative to said annular face cut, reversing the blank end-for-end, making a first spherically convex cut at said end of the blank of a predetermined radius such that the distance between the inner and outer surfaces is of a predetermined thickness and making a flange cut at the marginal edge of the outer convex surface of lesser radius of curvature; and apparatus for carrying out the method.

29 Claims, 20 Drawing Figures

METHOD AND APPARATUS FOR MANUFACTURING PLASTIC LENSES

BACKGROUND OF THE INVENTION

The object of this invention is to manufacture plastic lenses for distribution to optometrists, ophthalmologists, opticians, etc. which have optical surfaces which require minimal polishing to obtain the desired prescribed optical properties and lens thickness ready for tailoring of their inner surfaces to the surface contours of the wearer's eye.

SUMMARY OF THE INVENTION

The method of making contact lenses according to this invention comprises supporting a lens blank at one end for rotation about a predetermined axis, turning the side surface of the blank down to a true cylinder of predetermined diameter, facing the distal end in a plane perpendicular to the axis of rotation to form an annular surface of predetermined radial width, generating a concave surface at said end of predetermined depth at the center with respect to the plane of the annular surface, leaving a predetermined portion of said annular surface intact, reversing the blank, generating a convex surface at the opposite end on a radius set on the axis of rotation at the concave side of the blank corresponding to the depth of the concave surface plus the thickness at the center of the lens to be made and thereafter generating a convex surface at said end on a radius centered on the axis of rotation at the concave side which is greater than the radius of curvature of the concave surface and less than that of said convex surface.

The apparatus for practicing the method comprises a first lathe provided with an arbor to which the blank is adapted to be mounted with one end fixed to the arbor and with the other end extending radially therefrom for rotation about said axis, tools mounted adjacent the arbor for successively turning the blank down to a predetermined diameter, facing the distal end to form an annular face at said end of a predetermined radial width perpendicular to the axis of rotation and generating a spherically concave base cut in the distal end of a predetermined depth relative to said annular face cut, a second lathe provided with an arbor to which the concavely cut end of the blank is adapted to be mounted for rotation about its axis and a tool mounted adjacent the arbor of the second lathe for generating a spherically convex center cut of predetermined radius of curvature concentric with the spherically concave base and with its center at a predetermined distance therefrom and a surrounding spherically convex flange cut of lesser radius of curvature.

The invention will now be described in greater detail with reference to the accompanying drawings, wherein:

FIG. 1 is a section of a typical lens which is to be made according to the method of this invention;

FIG. 2 diagrammatically illustrates the turning and facing operations on the blank of which the lens is to be made;

FIG. 3 diagrammatically illustrates the making of the spherically concave surface or base cut at the end of the blank which constitutes the eye-contacting surface;

FIG. 4 diagrammatically illustrates making the outer spherically convex surfaces of the lens;

Figure 15:
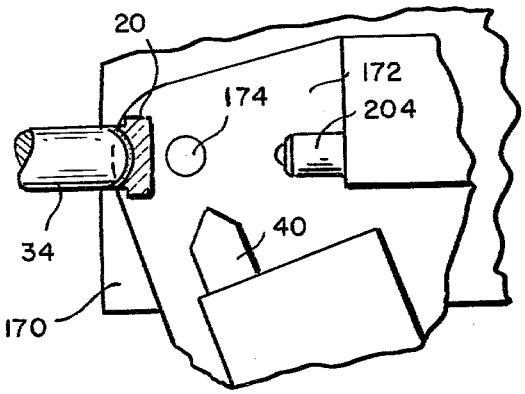
Figure 16:
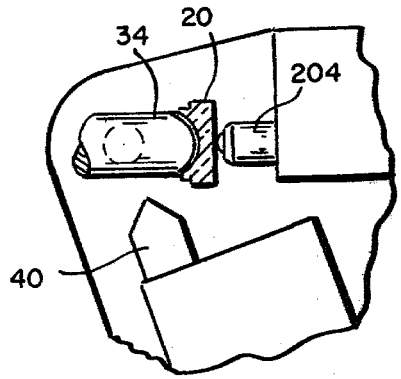
Figure 17:
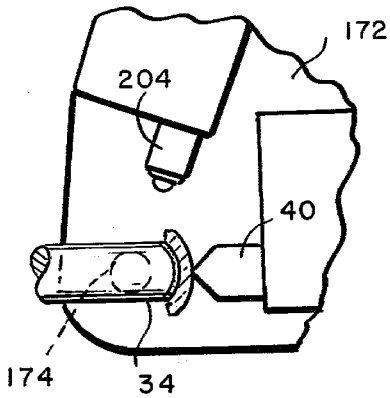
Figure 18:
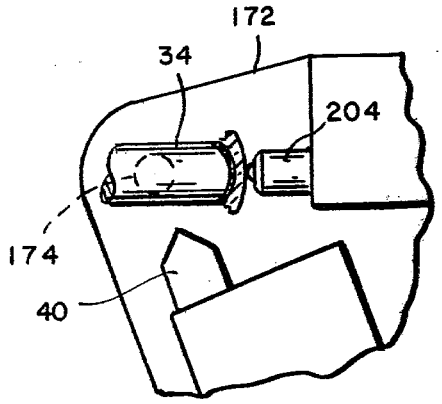
Figure 19:
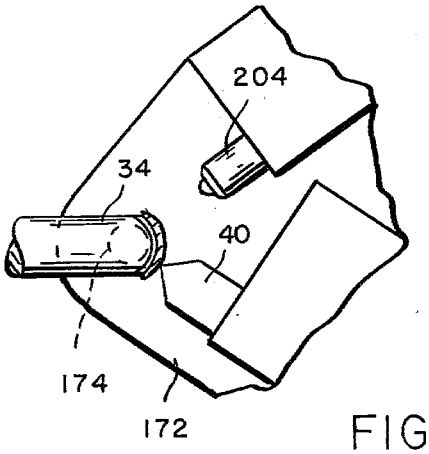
Figure 20:
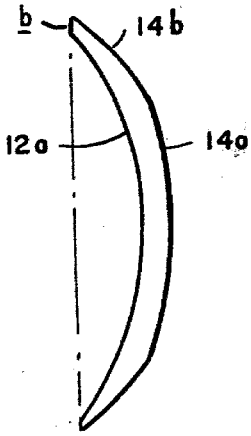

FIG. 15 diagrammatically illustrates the retracted position of the tool prior to sensing;

FIG. 16 diagrammatically illustrates the initial contact of the sensor with the end of the blank;

FIG. 17 diagrammatically illustrates the cutting tool in the process of generating the outer convex surface;

FIG. 18 diagrammatically illustrates contact of the sensor with the finished outer convex surface;

FIG. 19 diagrammatically illustrates the cutting position of the tool in the process of generating the flange cut; and FIG. 20 is a section of the lens after it has been processed according to this invention and before the inner side has been cut to fit the eye.

Figure 1:
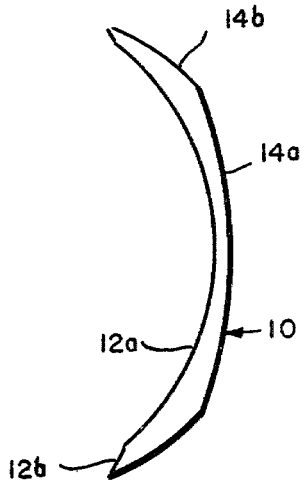

Referring to the drawings, FIG. 1, there is shown a finished lens blank 10 having inner spherically concave surfaces **12*a* and 12*b* and outer spherically convex surfaces 14*a* and 14*b*. The surfaces 12*b*, 14*a* and 14*b* are made according to the method as herein to be described. The surface 12*a*** is made by the optometrist or optician, since the inside edge of the lens is the only part of the inside surface of the lens that contacts the wearer's eye, to fit the contour of the wearer's eye and, hence, must be tailored to the contours of the eye.

Figure 2:
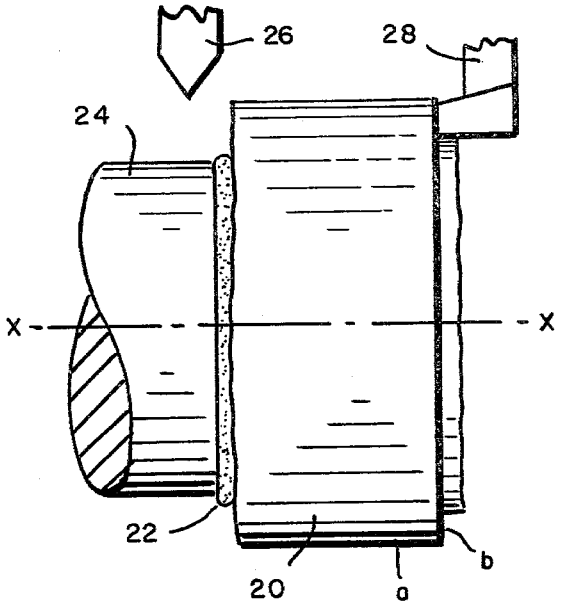
Figure 3:
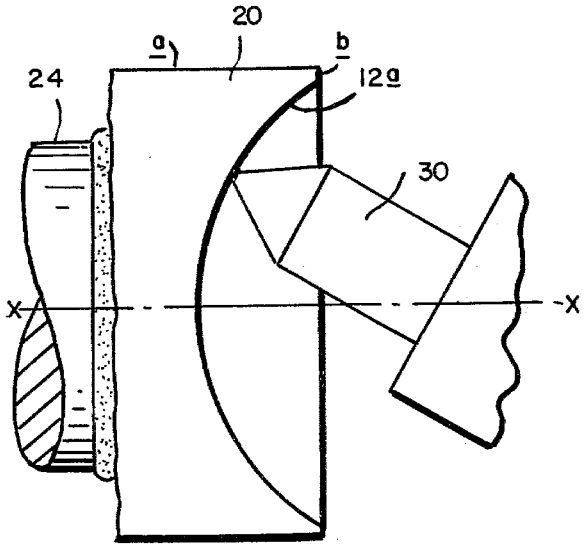
Figure 4:
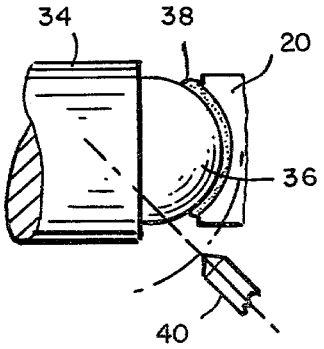

According to the method of this invention, a blank 20 of suitable plastic of roughly cylindrical section and of suitable length is attached at one end by means of an adhesive wax 22, FIG. 2, to an arbor 24 mounted in the chuck of a lathe for rotation about an axis X—X. The blank 20 is turned down to generate a cylindrical surface a of predetermined diameter by a tool 26 which is radially adjustable to the diameter required and movable parallel to the axis X—X. Following the turning operation, a facing tool 28 is moved radially inwardly toward the axis of rotation a predetermined radial distance to generate a smooth, annular face cut b of predetermined radial width, leaving the portion of the blank inwardly thereof still rough as indicated in FIG. 2 herein. After the annular face cut b has been generated, the tools 26 and 28 are withdrawn and the spherically concave base cut **12*b* is generated in the end face of the blank, as illustrated in FIG. 3, by means of a tool 30 which is oscillated between the center, that is, the axis of rotation X—X and one side of the blank and, while oscillating, advanced axially to make the cut of the desired depth relative to the face cut b, leaving a portion of the annular face cut peripherally of the concave base cut. The tool 30 is now withdrawn and the blank with the concave base cut 12***a* at the one end is removed from the arbor 24 and the concave base cut 12*a* is polished. The partially finished blank is now reversed end-for-end as shown in FIG. 4 and attached to an arbor 34 having a convex surface 36 corresponding substantially to the concave base cut in the lens blank by means of an adhesive wax 38 and adjusted until it runs true, whereupon the spherically convex surfaces 14*a* and 14*b* are generated by means of a tool 40, FIGS. 14 to 19, which is oscillated between the center, that is, the axis of rotation and one side of the blank and, while being oscillated, advanced axially to reduce the blank to the desired center and marginal thickness. The blank is now removed from the arbor 34 and the surfaces 14*a* and 14*b* polished. This completes the preparation of the blank for use except for the final fitting which, as previously indicated, is performed by the optometrist or optician.

Figure 14:
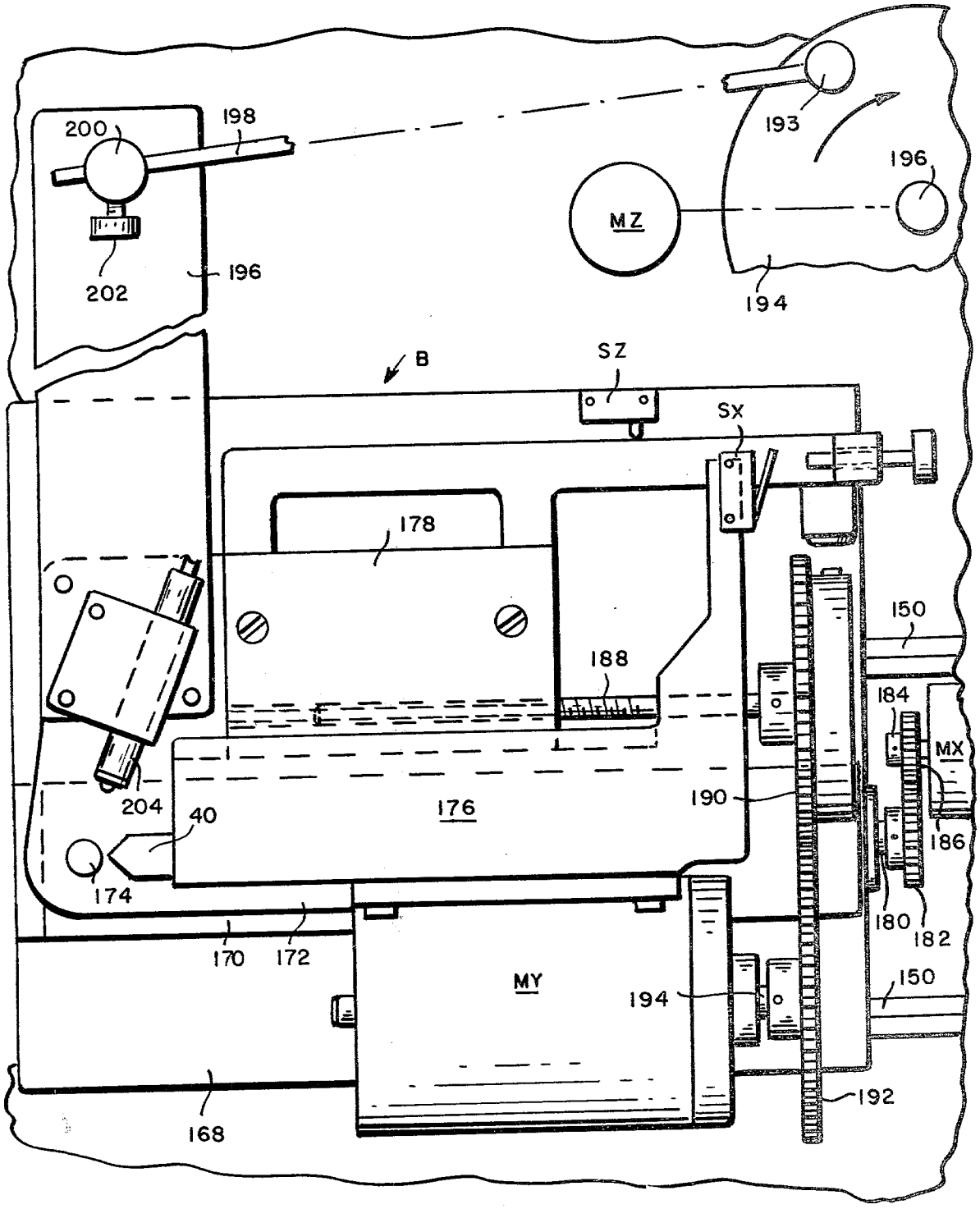
FIG. 14 is a plan view of an attachment provided with a tool for generating the spherically convex outer surfaces of the lens blank.

Apparatus for carrying out the method comprises attachments A, FIGS. 5 to 13, for performing the turning operation, the facing operation, and for generating the spherically concave inner surface 12*a* of the lens and an attachment B, FIG. 14, for generating the spherically convex outer surfaces 14*a* and 14*b* of the lens. These attachments, as will now be described, are mounted to conventional lathes. Since the lenses are composed of plastic, the cutting tool used in conjunction with the attachments need not be provided with hardened cutting tips as would be required in making glass lenses.

Referring specifically to FIGS. 5 to 13, FIG. 5 shows a plan view partly in section of a lathe 42 provided with a chuck 44 in which there is secured an arbor 24 for rotation of the latter about a horizontal axis X—X. The lens blank 20 to be operated on is attached to the end of the arbor 24 by means of wax 22 as heretofore pointed out. The lathe 42 is provided with a face plate 48 and the facing and turning tools 26 and 28 are mounted to the face plate 48 for movement rectilinearly relative to the axis of rotation X—X for rotation about an axis Y—Y spaced from and parallel to the axis X—X and for radial movement relative to the axis X—X. The support comprises an arm 50 fixed at one end to one end of a shaft 52 by a clamp bolt 53. The shaft 52 is mounted for axial movement as well as rotational movement about its axis Y—Y within a sleeve 54 in supporting bearings 56—56. The sleeve 54 is fastened by bolts 58, one of which is shown, to the face plate 48.

Axial movement of the shaft 52 and, hence, of the tools is effected by a socketed part 60 fixed to the inner end of the shaft 52 which has a threaded portion 62, the threads of which are engaged within complementary threads in a rotatably mounted coupling 64 mounted within the sleeve 54 in bearings 66—66 and restrained from axial movement therein. The coupling 64 protrudes axially from the sleeve 54 and has fixed to it a sheave 68 and the latter is rotated by a belt 70, one end of which is entrained about the sheave 68 and the other end of which is entrained about a sheave 72 fixed to the shaft 73 of the motor M1. The motor M1 is reversible so as to enable rotating the screw threaded coupling 64 in either direction and thus to move the shaft 52 longitudinally in either direction.

Figure 5:
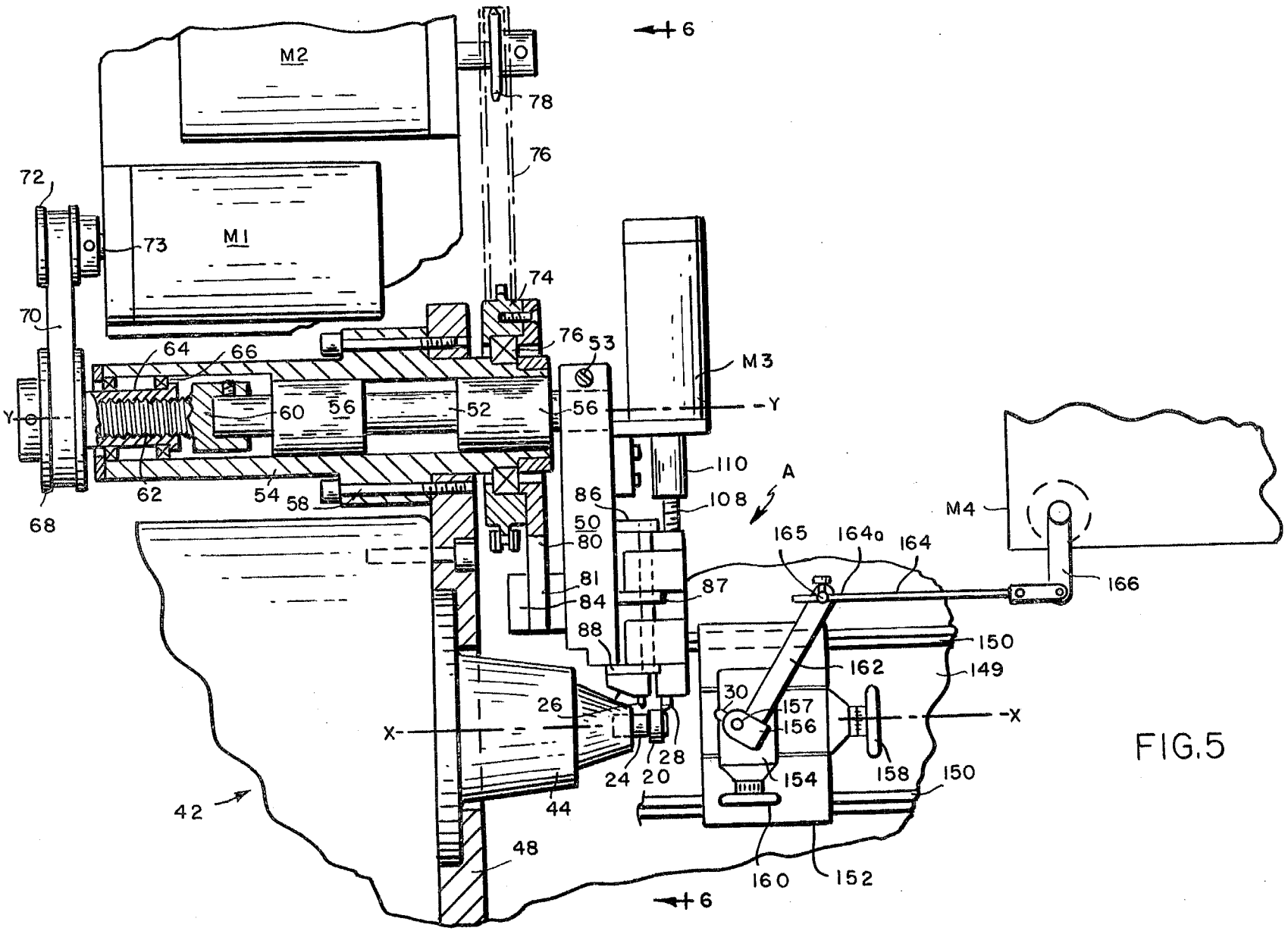
FIG. 5 is a plan view of attachments provided with tools for turning and facing the lens blank and for cutting the spherically concave eye-contacting base surface of the lens.
Figure 7:
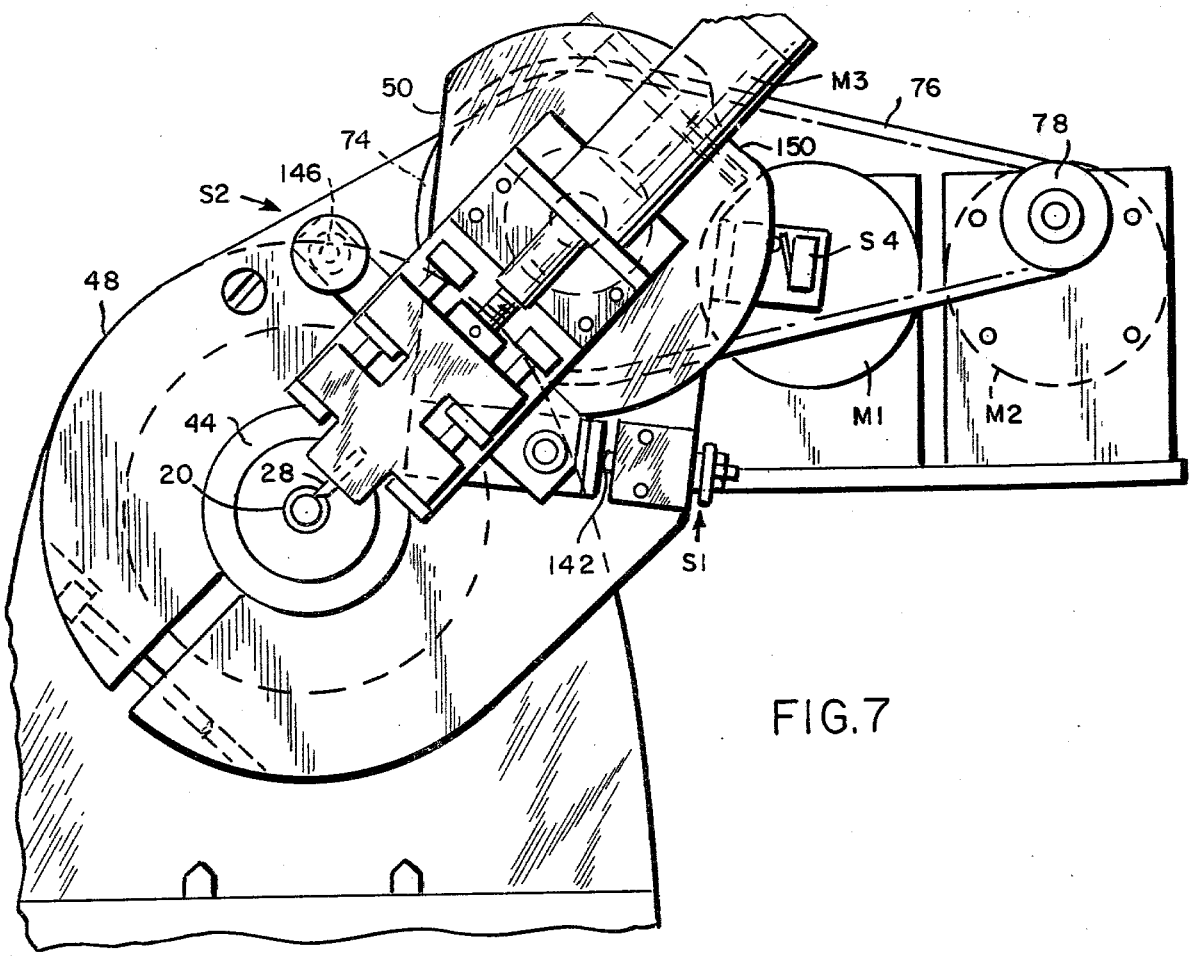
FIG. 7 is a view similar to FIG. 6 showing the support for the turning and facing tools lowered to an operative position.
Figure 6:
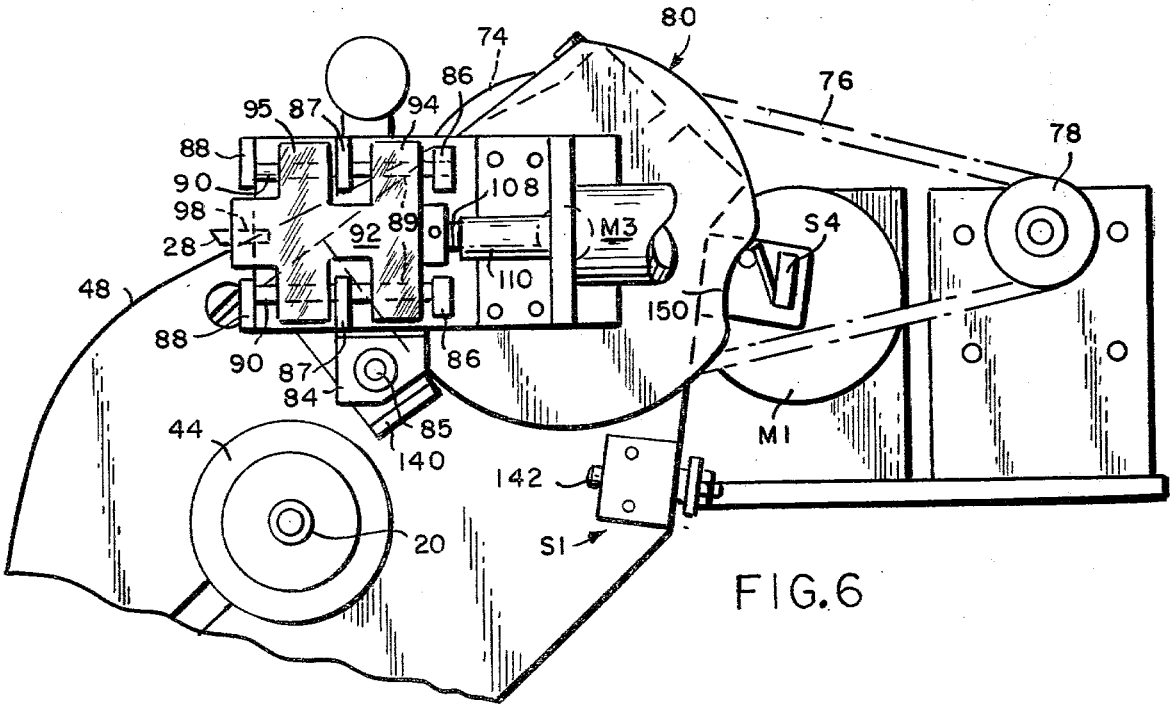
FIG. 6 is an end view taken on the line 6—6 of FIG. 5 showing the support for the turning and facing tools elevated to a retracted position.
Figure 8:
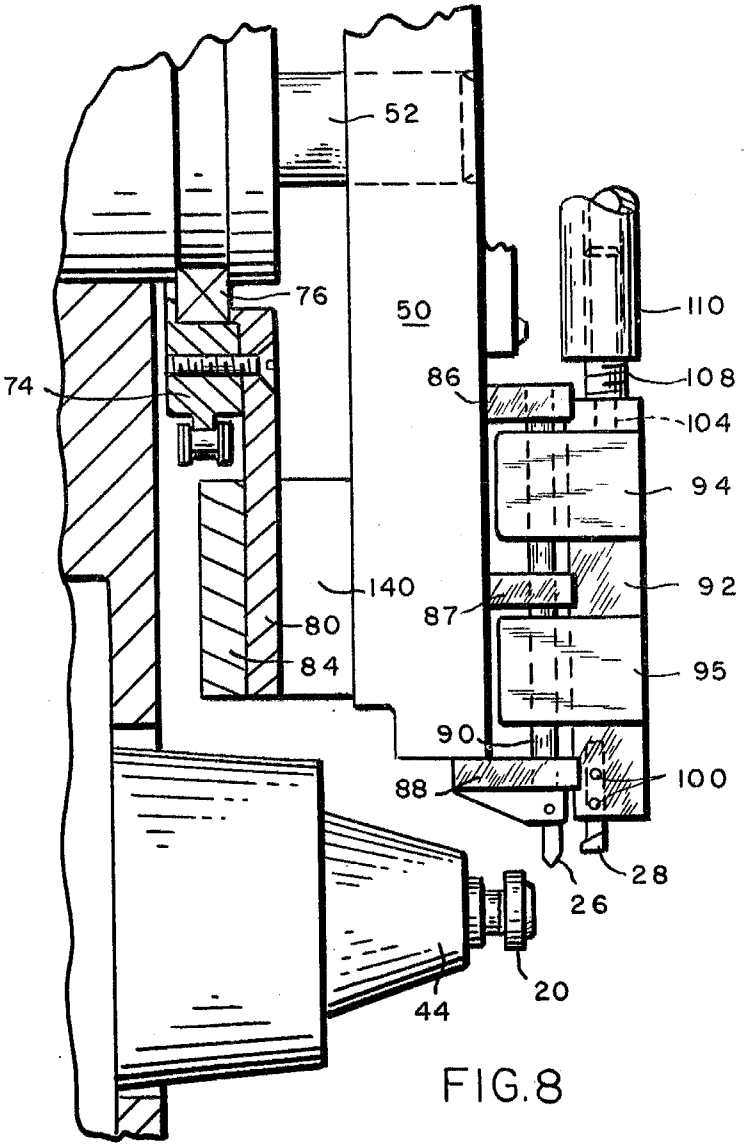
FIG. 8 is a plan view showing the support for the turning and facing tools at a ready position preparatory to turning the blank.
Figure 9:
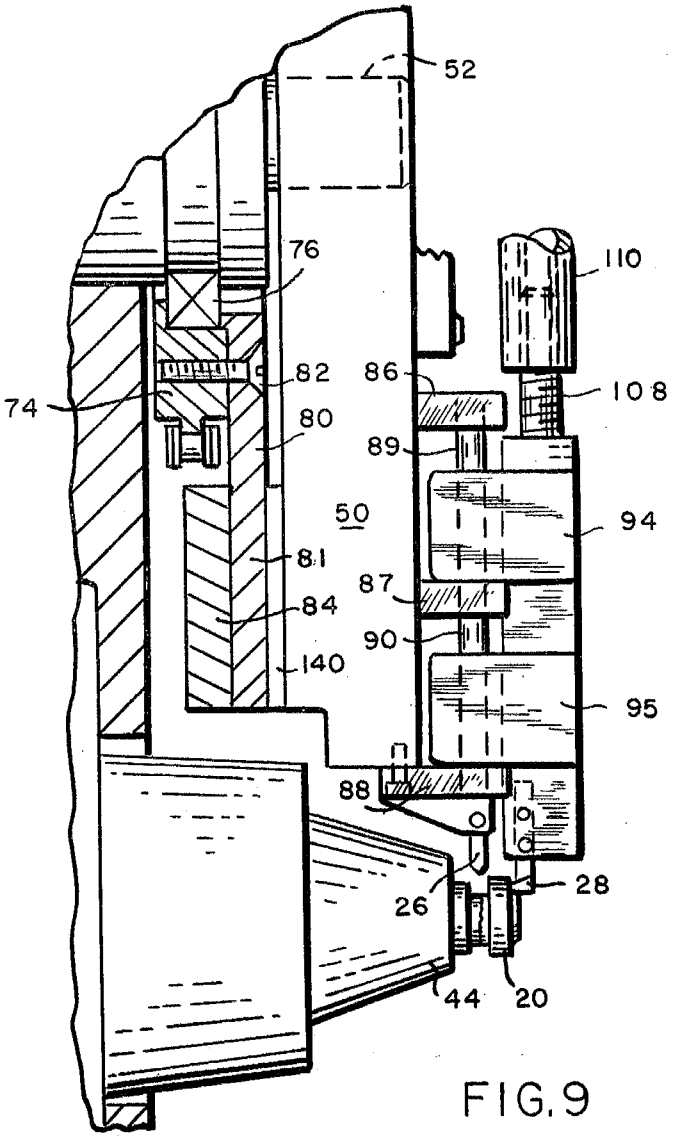
FIG. 9 is a view similar to FIG. 8 showing the support for the turning and facing tools in a position in which the turning has been completed and the facing tool is in an operative position.

The shaft 52 is rotatable about its axis and the arm 50 is fixed to the shaft 52 so as to be movable about the axis of rotation of the shaft to enable moving the tools from an elevated out-of-the way position, FIG. 6, to an operative position, FIG. 7, and following the cutting operation, to retract them to their inoperative position. Such pivotal movement is provided for by a toothed wheel 74, FIG. 5, mounted by means of a bearing 76 on the sleeve 54 so as to be rotatable thereon. Rotation of the toothed wheel 74 is provided for by a chain 76, one end of which is entrained about the toothed wheel 74, and the other end of which is entrained about a sprocket 78 fastened to the shaft of a motor M2. A plate 80, FIGS. 8 and 9, provided with an extension 81 is fastened by means of screw bolts 82 to the face of the toothed wheel 74 so as to be rotatable thereby and the extension 81 has at its distal end a bracket element 84 to which there is fixed a pin 85 which is slidably engaged within an opening 87 at the distal end of the arm 50. Thus, it is possible by rotation of the toothed wheel 74, plate 80 and extension 81 to turn the arm 50 about the axis Y—Y. The extent of arcuate movement of the arm 50 about the axis Y—Y is depicted in FIGS. 6 and 7 which, respectively, show the retracted position of the tool supporting arm 50 and the operative position of the tool supporting arm 50.

Figure 10:
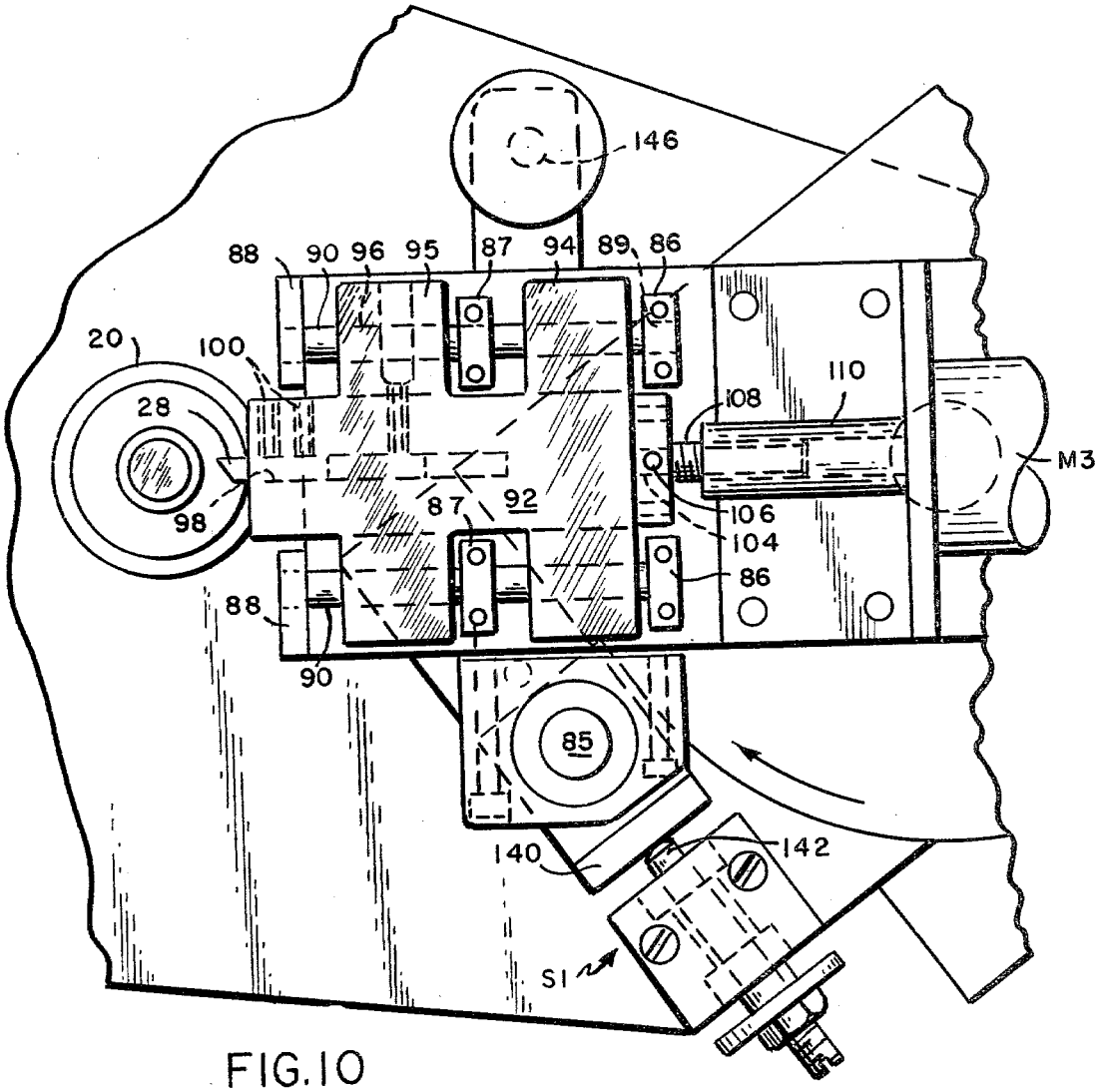
FIG. 10 is an elevation showing the means for supporting the turning tool for adjustment.

The arm 50 supports the tools and, for this purpose, has on its outer side spaced bearing blocks 86, 87 and 88 containing aligned openings 89 within which there are mounted spindles 90—90. A block 92, FIG. 10, provided with pairs of spaced bearing members 94,95 containing openings 96 is slidably mounted on the spindles 90—90. The forward end of the block 92 contains an opening 98 for receiving the facing tool 28, the latter being fixed in the opening by set screws 100. The rear end of the block 92 contains an opening 104, FIG. 13, within which there is fixed by means of a set screw 106 at one end of a screw 108. The opposite end of the screw is threaded into a sleeve 110 fixed to the shaft of a reversible stepping motor M3, FIG. 6. The reversible stepping motor M3 provides for advancing and retracting the block 92 and, hence, the end facing tool 28. Between the pairs of bosses 86, 87 and 88, there is mounted a block 116, FIG. 11, which has at its forward end an opening 118 for receiving the turning tool 26, the latter being fixed therein by set screw 120. The block 116 has on it a dovetail 121, FIG. 11, which is slidably retained in engagement with the arm for longitudinal movement thereon between a fixed shoulder 122 and a shoulder 124, the latter being attached to the arm by means of bolts 126. The block 116 contains a longitudinal opening 128 which is threaded and a screw 130 is mounted in the opening with its rear end 132 rotatably constrained within a block 134. The forward end of the screw contains a slot 136 for receiving, for example, a screwdriver by means of which the screw may be rotated to adjust the block 116. Adjustment of the block 116 provides for positioning the turning tool at the desired radial distance from the axes of rotation to turn the blank to the desired diameter.

Figure 11:
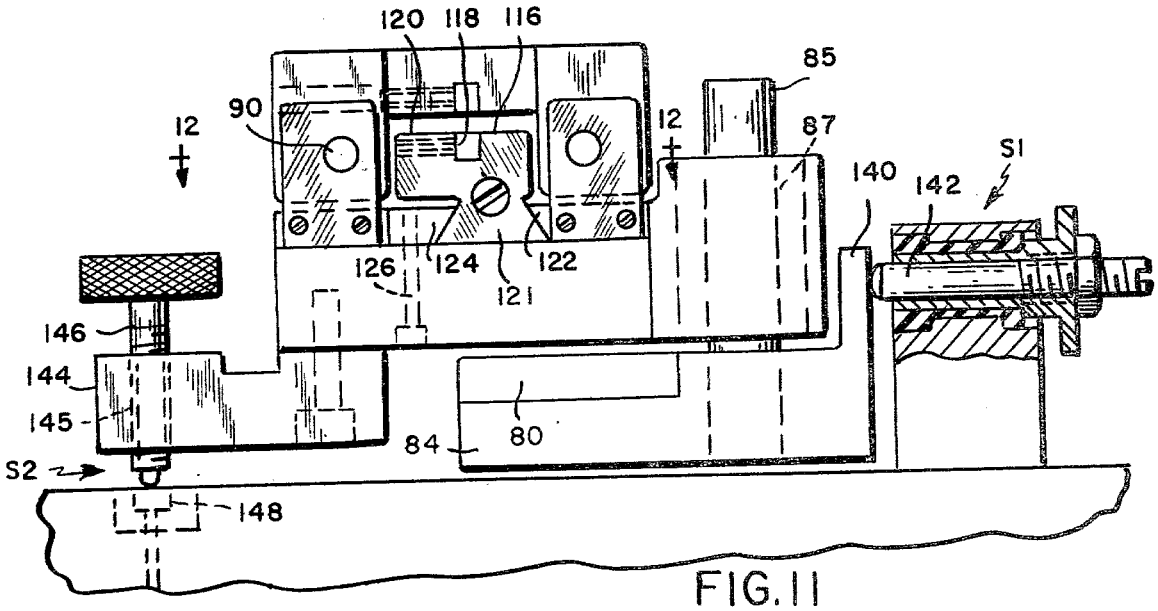
FIG. 11 is a plan view of FIG. 10.
Figure 12:
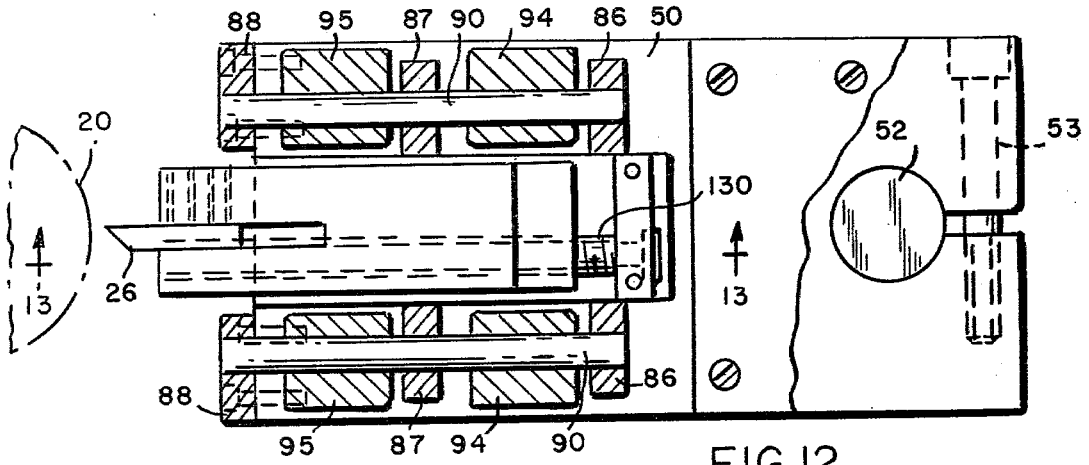
FIG. 12 is a section taken on the line 12—12 of FIG. 11.
Figure 13:
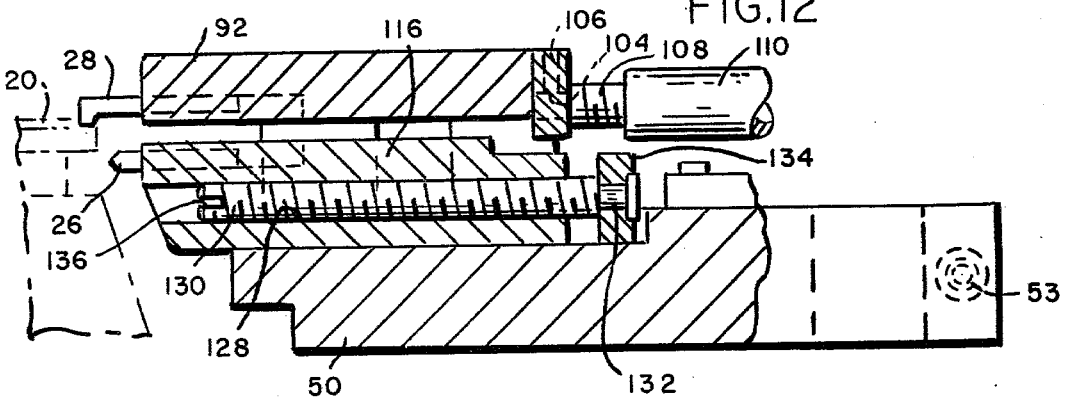
FIG. 13 is a section taken on the line 13—13 of FIG. 12.

The bracket 84 at the lower side of the arm 50 has a right angularly extending part 140, FIGS. 10 and 11, which is parallel to the axis of rotation of the arm 50 adapted by engagement with a limit pin 142 to support the arm 50 in its operative position. The limit pin 142 also constitutes a limit switch S1 which is actuated by movement of the arm to its operative position to initiate operation of the motor M1. At the upper side of the arm 50, there is an extension 144 containing a threaded opening 145 which is parallel to the axis of rotation within which there is mounted a screw 146. As the turning operation proceeds, the arm 50 is moved toward the faceplate 48 and there is mounted in the surface of the faceplate a block 148 which serves as a stop when the distal end of the screw 146 moves into engagement therewith to stop the axial movement of the shaft 52. The block 148 is part of a second limit switch S2 which is actuated by contact of the screw with the block 148 to stop the motor M1 and start the motor M3 which feeds the facing tool 28 inwardly for performing the facing operation. The depths of the radial facing cut is limited by a third limit switch S3 which, when actuated, stops the motor M3 and initiates operation of the motor M2 in the reverse direction so as to lift the arm 50 and, hence, the tools 26 and 28 away from the blank returning them to the position shown in FIG. 6. As the arm 50 rotates to the upper position of FIG. 6, a depression 150 in the edge of the plate 80 actuates a fourth limit switch S4 so as to reverse the motor M1 and cause the arm 50 to be moved away from the faceplate to position it in readiness for the next operation.

The tool 30 by means of which the base cut 12*a* is generated is mounted on the bed 149 of the lathe on which there are spaced, parallel ways 150—150, FIG. 5, by means of a first slide 152 mounted on the ways for movement longitudinally toward and away from the faceplate 48, a second slide 154 mounted on the first slide 152 for movement transversely of the ways and a swivel block 156 pivotally supported by a pin 157 on the slide 154 for oscillation about an axis perpendicular to the slide 154. There is micrometer feed means 158 for moving the slide 152 longitudinally and micrometer feed means 160 for moving the slide 154 transversely. The swivel block 156 contains an opening within which is mounted the tool 30. Oscillation of the tool 30 is provided for by an arm 162 fixed at one end to the swivel block 156 and connected at its other end to one end of a rod 164, the opposite end of which is connected to one end of an arm 166. The other end of the arm is connected to a motor M4 which effects oscillation of the arm 146 and, hence, of the arm 162. Oscillatory movement is controlled so as to move the tool 30 through an arc commencing outside of the radius of the blank and terminating on the axis of rotation of the blank. The means 158 and 160 as shown in FIG. 5 are manually rotated; however, step motors may be used to effect their operation. The arc of the oscillation may be adjusted by adjusting the end 164*a* of the rod 164 in the post 165 at the end of the arm 162.

As previously related, following the operations performed by the attachments thus far described by means of which the blank is turned down to a predetermined diameter and the annular concave base cut generated, the blank is removed from the arbor 24, reversed end-for-end and secured to the end of an arbor 36 mounted in the chuck of a second lathe apparatus as shown in FIGS. 4 and 14 equipped with the attachment B.

The attachment B, FIG. 14, comprises a plate 168 fixed to the ways 150—150 of the lathe, a carriage plate 170 mounted by means of dovetailing elements on the plate 168 and the plate 170 for rectilinear movement toward and from the arbor 36, a swivel plate 172 pivotally mounted by means of a pivot pin 174 mounted on the plate 170 and a tool carrier 176 mounted by means of dovetail elements to a block 178 bolted to the swivel plate 172. The tool 40 is fixed to the carrier 176. A screw 180 having threaded engagement with the carriage plate 170 provides for effecting rectilinear movement thereof.

Rotation of the screw 180 is effected by meshing gears 182, 184, the latter being fixed to the shaft 186 of a step motor MX. A screw 188 journaled in the tool carrier 176 and having threaded engagement with the block 178 provides for moving the tool carrier rectilinearly on the swivel plate. Rotation of the screw 188 is effected by gears 190,192, the latter being fixed to the shaft 194 of a step motor MY. The swivel plate 170 has as laterally extending arm 196, the distal end of which is connected by a link 198 and an eccentrically mounted pin 193 affixed to a disk 194, the latter being oscillated about its center 196 by a motor MZ. Oscillation of the disk 194 will effect oscillation of the arm 196 and, hence, the swivel plate. The left end of the link 192 is adjustably connected to the distal end of the arm 190 by a post 200 containing a hole through which the link extends and a thumbscrew 202 screwed into the post against the link. Adjustment of the link 192 provides for adjusting the arc of oscillation. A sensing element 204 is mounted on the swivel plate adjacent the tool 40. Control of the apparatus to carry out the method as herein illustrated may be provided for by a prepunched tape and limit switches or by computer means. For making a lens of predetermined diameter with surfaces of predetermined radius of curvature, the turning tool 26 is adjusted radially with respect to the axis of rotation to provide for a predetermined radius of lens, the tool 28 is adjusted radially with respect to the axis of rotation and the limit switch S3 is adjusted to stop the operation of the motor M3 when the tool has moved said predetermined radial distance so as to provide an annular face cut of predetermined radial width and the tool 30 is adjusted relative to its axis of rotation to generate a concave cut of predetermined radius of curvature. The turning and facing operations are performed automatically by the aforesaid motors M1, M2 and M3. The concave base cut 12*a* is provided for by adjusting the tool 30 to center it with respect to the axis of rotation and advancing it up to the end face of the blank, whereupon the motor M4 is started to effect oscillation of the tool and the latter is advanced by the micrometer feed screw 158 a predetermined distance relative to the end face. The depth required can be easily calculated by adding to the setting of the micrometer screw at the point of contact of the tool with the end the depth required. With a blank 20 attached to the arbor 24, the cycle which produces a blank of predetermined diameter with a base cut of predetermined radius of curvature and depth is initiated by starting the motor M1. Operation of the motor M1 moves the turning tool 26 axially of the arbor so as to perform the turning operation and when the tool reaches the end of the cut, the stop 148 prevents further movement of the carriage, and actuates the switch S2, which stops the motor M1 and simultaneously starts the motor M3. The motor M3 steps the tool 28 radially inwardly a predetermined selected distance which is determined by a limit switch S3 operable by engagement of a shoulder on the block 92 as the latter moves inwardly toward the axis of rotation to stop the motor. Actuation of the switch S3 simultaneously effects operation of the motor M2 so as to elevate the arm 50 and thus move the tools 26,28 away from the blank. At the elevated position of the arm 50, the switch S4 is actuated by the cam 150 to reverse the motor M1, thus to move the tools 26,28 back to their initial position. The operator now moves the tool 30 up to the end of the blank and with this as a starting point, and knowing the depth of the base cut to be made, starts the motor M4 which effects oscillation of the tool 30 and manually advances the tool 30 to make a cut of the selected depth. Alternately, a sensing device may be employed to determine the starting point by contact with the face cut which will supply a signal to a step motor for feeding the tool inwardly relative to the face cut a sufficient distance from the base cut. When the base cut has been completed, the tool 30 is withdrawn and the blank is then removed from the arbor and the base cut polished.

As previously related, the blank is now reversed end-for-end and adhesively attached to the arbor 34 as shown in FIGS. 14 to 19. The several motors which control operation of the cutting tool 30 by means of which the outer convex surfaces are made are also controlled by punched tapes or computer means. First, a tool 40 is adjusted radially with respect to its pivot axis 174 to cause it to travel in a predetermined radius of curvature. This is accomplished by operation of the motor MY. Having thus adjusted the tool and fixed a blank to the arbor 34, the operation which results in generating the convex outer surfaces 14*a* and 14*b* is initiated by swinging the swivel plate 172 about the axis 174 to align the sensor 204 with the axis of rotation, FIG. 15, and starting the motor MX. The motor MX moves the carriage and, hence, the sensor toward the arbor from the position shown in FIG. 15 to the position shown in FIG. 16 wherein the sensor 204 touches the end of the blank attached to the arbor, thus determining the distance between the end and the convex base cut surface 12. The sensor initiates operation of the motor MZ, thus oscillating the swivel plate and, hence, the tool and simultaneously signals the motor MX to feed the carriage 176 forwardly step-by-step to generate the desired surface of curvature and to obtain the desired center thickness of the blank. A switch SZ operable by engagement of the swivel plate reverses the motor MZ so as to effect oscillation from a dead center on the axis of rotation. When the surface 14*a* has been generated, the tool 30 is moved to one side and the sensor again moved into engagement with the finished surface as shown in FIG. 18 and if the latter has been cut to the proper contour, the sensor will signal the motor MY to back the tool away from the axis 174 a predetermined distance to increase the radius of oscillation of the tool, start the motor MZ to again initiate oscillation and start the motor MX so as to step the tool forwardly a predetermined distance to generate the flange cut 14*b*. Following completion of the flange cut, the tool is withdrawn and the blank may now be removed from the arbor and the two convex surfaces 14*a*, 14*b* polished. Retraction of the carriage is terminated by a switch SX which stops the motor MX.

The blanks are now ready to be supplied to optometrists, opticians and the like for grinding and fitting to the eyes of a prospective patient and, at this time, the flange cut 12*b* at the inner side of the blank is contoured to the surface of the eye of the wearer.

As previously related, the operation may be automated partly or wholly by employing prepunched tapes, limit switches, sensing devices, computer means and the like to control the several motors by means of which the operations are performed. Such means are well-known in the art and available to anyone skilled in the art for ordering the sequence of operation as described and, hence, need not be elaborated on further herein.

It should be understood that the present disclosure is for the purpose of illustration only and includes all modifications or improvements which fall within the scope of the appended claims.

We claim:

1. Apparatus for forming lenses from blanks comprising means for supporting a blank for rotation about a predetermined axis, a turning tool and a facing tool, means mounting the turning tool and facing tool for rectilinear movement in unison parallel to the axis of rotation of the blank in predetermined axially spaced relation such that rectilinear movement of said tools moves the turning tool from the distal end of the blank to the proximal end thereof to generate a cylinder of predetermined diameter and moves the facing tool to a ready position adjacent the distal end of the blank simultaneously with arrival of the turning tool at the proximal end of the blank, means for then moving the facing tool a predetermined distance at right angles to the axis of rotation to generate a flat annular surface at right angles to the axis of rotation at said end, means for retracting the tools, a tool for generating a sphericaly concave base cut in the distal end of the blank of predetermined radius of curvature, means supporting said latter tool at the level of the axis of rotation for movement along said axis toward the distal end of the blank, means for oscillating said latter tool through an arc commencing outside the radius of the blank and terminating at the axis of rotation, means for moving the latter tool while oscillating toward the distal end of the blank to generate a spherically concave surface of predetermined depth relative to said annular surface bounded by a portion of the annular surface and means for retracting said latter tool at said predetermined depth.

2. Apparatus according to claim 1 comprising a limit switch adjacent the proximal end of the blank operable by the arrival of the turning tool at said end to stop rectilinear movement of the tools and to initiate radial movement of the facing tool, a second limit switch located in the path of radial movement of the facing tool operable when the facing tool is moved a predetermined radial distance to stop said radial movement and initiate retraction of said tools, and a third limit switch operable at the retracted position of the tools to return the tools to their initial position in readiness for the next operation.

3. Apparatus according to claim 1 comprising means for adjusting the radial distance of the turning tool from the axis of rotation.

4. Apparatus according to claim 3 wherein the means for adjusting the radial distance of the turning tool from the axis of rotation is a manually rotatable screw.

5. Apparatus according to claim 1 comprising means for limiting the extent of radial movement of the facing tool.

6. Apparatus according to claim 5 wherein there is a manually adjustable screw threaded element for adjusting the initial position of the facing tool.

7. Apparatus according to claim 1 wherein there is a screw supporting the tool support for rectilinear movement parallel to the axis of rotation and means mounting the tool support for rotation about the axis of the screw.

8. Apparatus according to claim 1 wherein there is a first member supported for movement axially with respect to the work support and means for effecting its movement, a second member supported for movement transversely with respect to the work support mounted on the first member and means for effecting its movement and swivel means mounting the tool for making the spherically concave cut on the second member for pivotal movement about a center located on the axis of rotation for movement along an arc corresponding in radius of curvature to the concave base surface to be generated.

9. Apparatus according to claim 8 wherein there is kinematic linkage connected to the tool for effecting its oscillation and motor means drivably connected to said kinematic linkage.

10. Apparatus according to claim 8 wherein there is means associated with the second member determinative of the position of the tool relative to the face cut.

11. Apparatus according to claim 8 wherein there is sensing means associated with the second member operable by engagement with the face cut to signal the motor means drivably connected to said member to feed the tool the distance required to generate the spherically concave base cut.

12. Apparatus according to claim 8 wherein there is means for adjusting the distance of the cutting end of the tool from its center of rotation.

13. Apparatus according to claim 12 comprising micrometer screw means for moving the tool transversely of the first member to center it on the axis of rotation and micrometer screw means for moving the tool longitudinally of the second member along the axis of rotation of the blank.

14. Apparatus according to claim 12 comprising motor-driven feed screw means for moving the tool rectilinearly along the axis of rotation into engagement with the end of the blank to establish a zero set point from which to make the concave base cut, said motor-driven feed screw means being operable thereafter to move the tool a further distance as determined by the set point of the tool at its point of initial contact with the end face and the depth of the cut to be made relative to the end face of the blank.

15. Apparatus according to claim 14 comprising sensing means movable with the tool up to the end of the blank, for determining the extent and movement of the tool necessary to reduce the blank to a predetermined center thickness between the concave and convex surfaces.

16. Apparatus according to claim 15 comprising a motor operable by said sensing means to effect movement of the tool the required distance.

17. Apparatus according to claim 16 wherein said sensing device is operable to measure the thickness of the lens at said center and, if the thickness is correct, to initiate the flange cut.

18. Apparatus for forming lenses from blanks comprising first and second lathes, said first lathe embodying means for supporting a blank for rotation about a predetermined axis, a turning tool and a facing tool, means mounting the turning tool and facing tool for rectilinear movement in unison parallel to the axis of rotation of the blank in predetermined axially-spaced relation such that rectilinear movement of said tools moves the turning tool from the distal end of the blank to the proximal end thereof to generate a cylinder of predetermined diameter and moves the facing tool to a ready position adjacent the distal end of the blank simultaneously with the arrival of the turning tool at the proximal end of the blank, means for then moving the facing tool a predetermined distance at right angles to the axis of rotation to generate a flat, annular surface at right angles to the axis of rotation at said end, means for retracting the tools, a tool for generating the spherically-concave base cut in the distal end of the blank of predetermined radius of curvature, means supporting said latter tool at the level of the axis of rotation for movement along said axis toward the distal end of the blank, means for oscillating said latter tool through an arc commencing outside the radius of the blank and terminating at the axis of rotation, means for moving the latter tool while oscillating toward the distal end of the blank to generate a spherically-concave surface of predetermined depth relative to said annular surface bounded by a portion of the annular surface, and means for retracting said latter tool at said predetermined depth and said second lathe embodying an arbor to which the concavely-cut end of the blank formed on the first lathe is adapted to be mounted for rotation about its axis and a tool mounted adjacent the arbor of the second lathe for generating a spherically-convex center cut of a predetermined radius of curvature concentric with the spherically-concave base cut and with its center at a predetermined distance therefrom and a surrounding spherically convex flange cut of lesser radius of curvature.

19. Apparatus according to claim 18 wherein there is means for moving the tool which generates the spherically concave base cut a predetermined distance toward the end of the blank so as to generate a surface of predetermined depth relative to the face cut and there is means for moving the tool which makes the spherically convex cuts a first predetermined distance toward the end of the blank to generate a spherically convex surface concentric with the spherically concave surface and a predetermined distance from the center of the concave face cut and a second predetermined distance toward the end of the blank at a lesser radius of curvature to make a convex flange cut peripherally of said convex cut.

20. Apparatus according to claim 18 comprising means supporting the tool which makes the concave base cuts for oscillation of its cutting end about a center located rearwardly of its cutting end at a radial distance corresponding to the desired radius of curvature of the concave surface and means supporting the tool which generates the convex cuts for oscillation of its cutting end along arcs, the centers of which are located forwardly of its cutting end at a radial distance corresponding to the desired radii of curvature of the convex surfaces.

21. Apparatus for forming lenses from blanks comprising means for supporting a blank for rotation about a predetermined axis and means for effecting rotation of the means supporting the blank, a turning tool and facing tool, a support mounting the tools, said support being movable rectilinearly parallel to said axis and for rotation in a plane perpendicular to said axis, motor means for rotating said suppport from an out-of-the-way retracted position to a position adjacent said axis, such that the tools supported thereby are in operative position, motor means for effecting rectilinear movement of the support to move one of the tools parallel to said axis at a predetermined radial distance therefrom to generate a cylindrical surface, motor means operable at the end of the turning operation to move the other tool radially inwardly a predetermined distance to generate a face cut, means operable at the end of the face cut to reverse the first motor means to retract the tools and means operable at the retracted position of the tools to effect operation of the second motor means to return the tools to their initial position.

22. Apparatus according to claim 21 wherein said support comprises a shaft supported for movement axially and for rotation about its axis, and an arm fixed at one end to one end of the shaft for movement therewith, first kinematic means connecting the first motor means to the distal end of the arm for effecting rotation of the arm about the axis of the shaft and second kinematic means connecting the second motor means to the shaft for effecting axial movement of the support.

23. Apparatus according to claim 22 wherein the first kinematic means is a sprocket supported for rotation about the axis of the shaft, a sprocket fixed to the drive shaft of the first motor means, a chain entrained about said sprockets, a lever fixed at one end to the sprocket and rotatable thereby, and a pin at the distal end of the lever parallel to the axis of rotation slidingly engaged with an opening at the distal end of the arm.

24. Apparatus according to claim 22 wherein the second kinematic means is a feed screw connected at one end to the shaft, a sprocket connected to the other end of the feed screw, a sprocket fixed to the drive shaft of said second motor means and a chain entrained about said sprockets.

25. Apparatus according to claim 21 wherein there is a carriage mounted on the arm for movement thereon radially with respect to the axis of rotation of the arm, to which the facing tool is mounted and motor means connected to the carriage for effecting its movement.

26. Apparatus according to claim 21 wherein there is a slide mounted on the arm for movement thereon radially with respect to the axis of rotation of the arm which mounts the turning tool and there is a screw mounting the turning tool to the slide such as to enable adjusting the radial distance of the turning tool relative to the axis of rotation.

27. Apparatus according to claim 21 wherein there is a limit stop situated in a position to limit rotational movement of the arm as it is moved from its retracted position to its operative position, and switch means operative at said limiting position to initiate operation of said second motor means.

28. Apparatus according to claim 21 wherein there is a limit stop situated in a position to limit rotational movement of the arm as it is moved from its operative position to its retracted position and switch means operative at said limiting position to stop said second motor means and initiate operation of said first motor means to return the tools to their initial position.

29. Apparatus according to claim 21 wherein there is a limit switch operable by forward movement of the carriage on the arm to reverse the operation of the third motor means to retract the facing tool.

* * * * *